US006076675A

United States Patent [19]

Pawlowski

[11] Patent Number: 6,076,675

[45] Date of Patent: Jun. 20, 2000

[54] PRESENTATION AND HOLDING DEVICE FOR SMALL-FORMAT OBJECTS

[76] Inventor: Volker Pawlowski, Henningstaedter Weg 5, 13503 Berlin, Germany

[21] Appl. No.: 08/725,874

[22] Filed: Oct. 4, 1996

[30] Foreign Application Priority Data

Jan. 30, 1996 [DE] Germany ..... 296 01 520

[51] Int. Cl.[7] ..... B65D 75/26

[52] U.S. Cl. ..... 206/459.5; 206/463; 229/92.8

[58] Field of Search ..... 206/461–471, 206/459.5, 457; 229/92.8

[56] References Cited

U.S. PATENT DOCUMENTS

| | | | |
|---|---|---|---|
| 1,168,592 | 1/1916 | Bedinger . | |
| 1,180,618 | 4/1916 | Stirn | 206/462 |
| 1,903,540 | 5/1933 | Webster . | |
| 2,363,472 | 12/1944 | Ritter . | |
| 3,047,143 | 7/1962 | Voight | 206/467 |
| 3,193,182 | 7/1965 | Yakovljevic . | |
| 4,091,927 | 5/1978 | Lunsford | 206/467 |
| 4,430,843 | 2/1984 | Favale . | |
| 4,499,353 | 2/1985 | Shields | 206/470 |
| 4,807,806 | 2/1989 | Neiman . | |
| 4,840,275 | 6/1989 | Faiola et al. . | |
| 4,842,140 | 6/1989 | Mesnard | 206/459.5 |
| 4,870,764 | 10/1989 | Boone . | |
| 4,905,828 | 3/1990 | Dods | 206/461 |
| 4,951,404 | 8/1990 | Lithwick . | |
| 5,119,952 | 6/1992 | Warrimer, Jr. . | |
| 5,607,101 | 3/1997 | Saito | 229/92.8 |

FOREIGN PATENT DOCUMENTS

| | | | |
|---|---|---|---|
| 1224274 | 10/1968 | United Kingdom | 206/463 |
| 2025766 | 1/1980 | United Kingdom | 206/462 |

*Primary Examiner*—Jim Foster

*Attorney, Agent, or Firm*—Brown, Martin, Haller & McClain

[57] ABSTRACT

A presentation and holding device for small-format objects has at least two transparent joinable halves that form a hollow body when fitted together into a corresponding opening in a presentation surface, such as a picture postcard. The hollow body is effectively used to contain an object which has some connection with the motif presented on the picture postcard.

9 Claims, 1 Drawing Sheet

PRESENTATION AND HOLDING DEVICE FOR SMALL-FORMAT OBJECTS

BACKGROUND OF THE INVENTION

Holding devices for small-format objects are already known, in which, for example, the objects are glued to a presentation surface. Such use includes free-standing PLEXIGLAS containers or inclined surfaces. These surfaces are suitable for use as souvenir articles, and also as promotional gifts. In addition, small objects cast in synthetic resin are already known, which are often given away as promotional gifts. Thus, for example, computer companies often distribute microchips which have been cast in synthetic resin. These objects made of synthetic resin can themselves be used as "table decorations." A disadvantage of these implementations is their limited manner of use. These objects can only be sent by mail as packages or small packages, or distributed in person. Promotional gifts of this type are customarily distributed with accompanying literature, which is intended to establish the connection between the promotional gift and the advertising company.

SUMMARY OF THE INVENTION

The present invention relates to a presentation and holding device for small-format objects, and includes a hollow body attached to a presentation surface such as a picture postcard. In an exemplary embodiment the hollow body includes at least two transparent joinable sections or halves. The purpose of the present invention is to create a device which makes it possible to present small-format objects to the public for souvenir or promotional purposes as mass items. This task is solved in that the halves are manufactured to be detachably connectable, in that the hollow body can be fitted into a corresponding cutout in a presentation surface with the dimensions of the hollow body, whereby the presentation surface is held by the connecting seam formed by the halves. These measures create a device in which small objects can easily be placed in a hollow body, while this hollow body, due to its transparent characteristics, permits the viewing of the object contained therein.

The hollow body itself is immovably held by a presentation surface, preferably a picture postcard. Customarily, some kind of motif or subject is shown on a picture postcard, such as a photograph of the wrapped Reichstag building in Berlin. Because the picture postcard is provided with a cutout which corresponds to the hollow body, the picture postcard can be joined to the hollow body. The hollow body is effectively used to contain an object which has some connection with the motif presented on the picture postcard. In the example of the Reichstag building which was wrapped by Christo, the artist, this could be a piece of the wrapping material as a small object in the hollow body which is connected to the picture postcard. Additional examples for an advantageous use of this invention are the motif of the Berlin Wall on the picture postcard, with a piece of the Wall placed in the hollow body, or also individually designed picture postcards with any possible motif, and any small object, exchangeable depending upon the motif. The presentation object can also be air, i.e., the hollow body is only filled with air, for example "Berlin Air."

In an exemplary embodiment, the halves are provided with a connecting projection or connecting groove, using which the halves are connectable to form the hollow body. Assembly of the two halves forms a connecting seam, which itself holds the picture postcard. In this manner, the hollow body with the object contained therein is immovably connected with the picture postcard, so that this "modified" picture postcard is also suitable for mailing as a normal postal piece.

By using transparent plastic as the material for the hollow body, the weight of the picture postcard hardly increases, so that the mailing costs for the picture postcard are hardly affected by it.

Furthermore, the halves may be formed in a convex shape. In this way, the presentation object contained in the hollow body is subjected to a magnifying effect similar to that of a magnifying glass. Furthermore, the diameter of the halves may be a multiple of the length of the cross-section of the assembled hollow body. This makes it possible for the dimensions of the picture postcard, particularly its depth, not to increase significantly, so that sending it by mail is possible.

The foregoing, together with other features and advantages of the present invention, will become more apparent when referring to the following specification, claims, and accompanying drawings.

DESCRIPTION OF A PREFERRED EMBODIMENT

Figure 1:
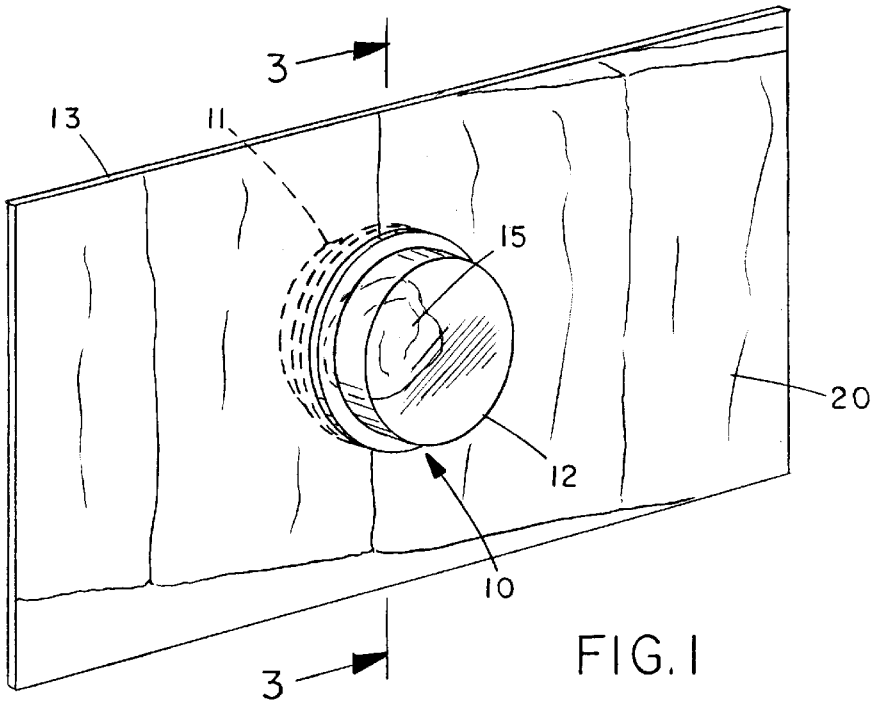
FIG. 1 is a frontal perspective view of a picture postcard with the invented holding device.
Figure 2A:
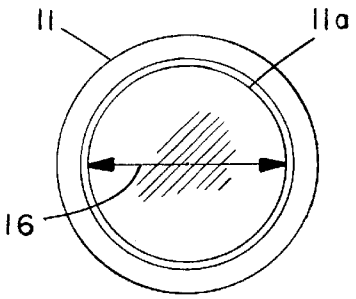
FIG. 2*a* is an interior view of a half with the connecting projection.
Figure 2B:
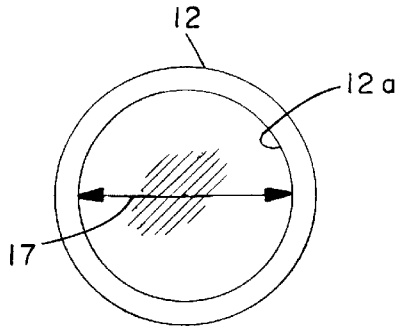
FIG. 2*b* is an interior view of a half with the connecting groove.
Figure 3:
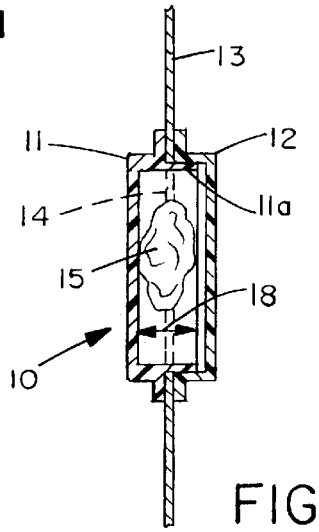
FIG. 3 is a side view of a picture postcard with an integrated holding device, specifically with the hollow body with the presentation object contained therein, in cross-section.

FIG. 1 shows a picture postcard 13 with a hollow body 10 located centrally in the picture postcard. This hollow body 10 consists of two halves 11 and 12, as shown in more detail in FIGS. 2*a* and 2*b*. On their outer edges, the halves 11 and 12 have a connecting device, specifically, on the one hand, a connecting projection 11*a*, which is connectable by insertion into a corresponding connecting cavity or recess 12*a* on the other half 12, as shown in FIG. 3. The halves shown are formed in a circular shape; however, any other geometrical form is conceivable here, for instance, half of a rectangular solid.

The cutout (not shown) in the picture postcard 13 is exactly identical in size to the interior diameters 16 and 17 of the halves 11 and 12. By insertably connecting the halves 11 and 12, a connecting seam 14 is created, which immovably holds the picture postcard 13 by means of its small overlap.

As shown in FIG. 3, the interior diameter 18 of the hollow body 10 is much smaller than the interior diameters 16, 17 of the halves 11 and 12. In this way, a holding device is created whose length is greater than its depth. This makes it possible for the picture postcard provided with the holding device to continue to fulfill its function as a mailable postcard. The presentation object 15 contained in the hollow body 10 can be held in the hollow body loosely or immovably, for example, using glue. In the illustrated embodiment, the exemplary presentation object 15 is a piece of the Berlin Wall, which is the subject 20 depicted on the front of the picture postcard 13. Hollow body 10 thus also contains air taken from Berlin.

The preferred material for the hollow body 10 is a transparent plastic, which may be a transparent colored plastic, that does not add appreciably to the weight of the picture postcard.

In addition to a convex form for the halves, which causes a magnifying effect of the presentation object contained therein, the invention also provides for a flat surface facing outward. The form using the flat surface has the advantage that the picture postcard provided with the holding device will not be excluded from routing at the post office using automated mail processing due to unsuitable dimensions.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A method for transmitting a postcard containing an object, comprising the steps of:

providing a postcard having a depiction of an edifice thereon;

providing a hollow body;

disposing said object in said hollow body, said object consisting of a piece of material taken from said edifice depicted on said postcard;

attaching said hollow body to said postcard; and mailing said postcard and attached hollow body.

2. The method recited in claim 1, wherein said step of providing a hollow body comprises the step of providing a hollow body that has a transparent portion.

3. The method recited in claim 2, wherein said step of providing a hollow body comprises the step of providing a hollow body that is entirely transparent.

4. The method recited in claim 1, wherein said hollow body is cylindrical.

5. The method recited in claim 1, wherein;

said step of providing a hollow body comprises the step of providing a plurality of transparent joinable sections joinable to each other; and said step of disposing said object in said hollow body comprises the step of joining said transparent joinable sections to each other.

6. The method recited in claim 5, wherein each transparent joinable section has a diameter greater than a length of said hollow body.

7. The method recited in claim 5, wherein said step of attaching said hollow body to said postcard comprises the step of fitting said hollow body into a corresponding opening in said presentation surface with the postcard engaging a seam along which said transparent joinable sections are joined.

8. The method recited in claim 7, wherein:

one of said transparent joinable sections is formed as a unitary piece having a connecting projection;

one of said transparent joinable sections is formed as a unitary piece having a connecting recess; and said step of attaching said hollow body to said postcard comprises the step of mating said connecting projection with said connecting recess.

9. The method recited in claim 1, wherein said step of disposing said object in said hollow body comprises the step of loosely disposing said object in said hollow body.

* * * * *